United States Patent [19]

Schmied et al.

[11] Patent Number: 4,976,247

[45] Date of Patent: Dec. 11, 1990

[54] IGNITION DEVICE FOR COMBUSTION ENGINES

[75] Inventors: Helmut Schmied, Marbach; Bernd Kalkhof, Reutlingen, both of Fed. Rep. of Germany

[73] Assignee: Robert Bosch GmbH, Stuttgart, Fed. Rep. of Germany

[21] Appl. No.: 522,466

[22] Filed: May 11, 1990

Related U.S. Application Data

[63] Continuation of Ser. No. 272,985, filed as PCT DE87/00131 on Mar. 25, 1987, published as WO87/06651 on Nov. 5, 1987, abandoned.

[30] Foreign Application Priority Data

Apr. 30, 1986 [DE] Fed. Rep. of Germany ..... 3614773

[51] Int. Cl.[5] ..... F02P 9/00; F02P 3/12

[52] U.S. Cl. ..... 123/651; 123/609

[58] Field of Search ..... 123/651, 609, 415, 418, 123/610, 611; 307/350, 246

[56] References Cited

U.S. PATENT DOCUMENTS

| | | | |
|---|---|---|---|
| Re. 30,737 | 9/1987 | Caron | 123/415 |
| 4,176,645 | 12/1979 | Jundt | 123/609 |
| 4,276,860 | 7/1981 | Capurka | 123/415 |
| 4,308,848 | 1/1982 | Pfaff et al. | 123/651 |
| 4,359,652 | 11/1982 | Jarret | 307/350 |
| 4,446,843 | 5/1984 | Rumbaugh | 123/609 |

FOREIGN PATENT DOCUMENTS 2549586 5/1977 Fed. Rep. of Germany .

*Primary Examiner*—Raymond A. Nelli

*Attorney, Agent, or Firm*—Frishauf, Holtz, Goodman & Woodward

[57] ABSTRACT

The invention relates to an ignition device for combustion engines. The ignition device has a switching transistor (7) which, when a trigger is energized, is current-conductive, further an ignition coil (6), the primary winding (5) of which forms with the transistor (7) a series circuit, and, further, a signal transducer (10) connected in advance of the trigger (11) to supply a capacitor-charging current, after a lapse of a time period of its control signal (a, b) reaching a peak value. The threshold of the trigger (11) can be shifted relative to the control signal (a,b) by use of an electrical storage device (30) which can be charged and discharged, and in which the charge is dependent on the predetermined current value in the primary winding (5). In accordance with the invention, the storage device (30) can be charged by the control signal (a,b) and can be discharged over a shunt circuit branch (32) with high resistance value (resistor 33) as well as over a shunt circuit branch (34) with low resistance value (resistor 37). Upon reaching of a primary current value of predetermined level, the charging of the storage device (30) is stopped and the shunt circuit branch (34) with low resistance value is completed when transistors (36,38) become conductive.

20 Claims, 1 Drawing Sheet

IGNITION DEVICE FOR COMBUSTION ENGINES

This application is a continuation of application Ser No. 07/272,985, filed as PCT DE87/00131 on Mar. 25, 1987, published as WO87/06651 on Nov. 5, 1985, now abandoned.

The present invention relates to an ignition arrangement. An ignition arrangement in this sense is already known (according to German Patent No. 25 49 526 and corresponding U.S. Pat. No. 4,176,645, JUNDT-/BOSCH) which, however, in its operation is not satisfactory for every case. For example, it may occur there that due to variations in the speed or to dispersion of characteristics of the signal transducers which are being used, a switching threshold associated with a trigger may shift in an undesirable direction.

BACKGROUND

From U.S. Pat. No. 4,446,843, RUMBAUGH, an additional arrangement for combustion engine is also known, in which, however, the charging of a capacitor forming a storage device continues even when the storage device should be discharged. The discharged resistor's value must then be selected so low that feedback to the transducer connected thereto cannot be excluded. This circuit arrangement thus must be matched to the respective transducer.

The object of the invention is to provide an ignition system which overcomes the aforementioned problems.

This object is solved by simultaneously (1) ceasing to charge the capacitor and (2) connecting the fast-discharge shunt path. It is hereby particularly advantageous that, by diconnecting the charge process in the memory, the discharge need not be carried out too rapidly. This permits a relatively high resistance coupling, so that feedback effects to the transducer are avoided.

BRIEF FIGURE DESCRIPTION

An example of an embodiment of the invention is shown in the drawing in the form of a circuit, and described in the subsequent description in more detail.

DETAILED DESCRIPTION

Figure 1:
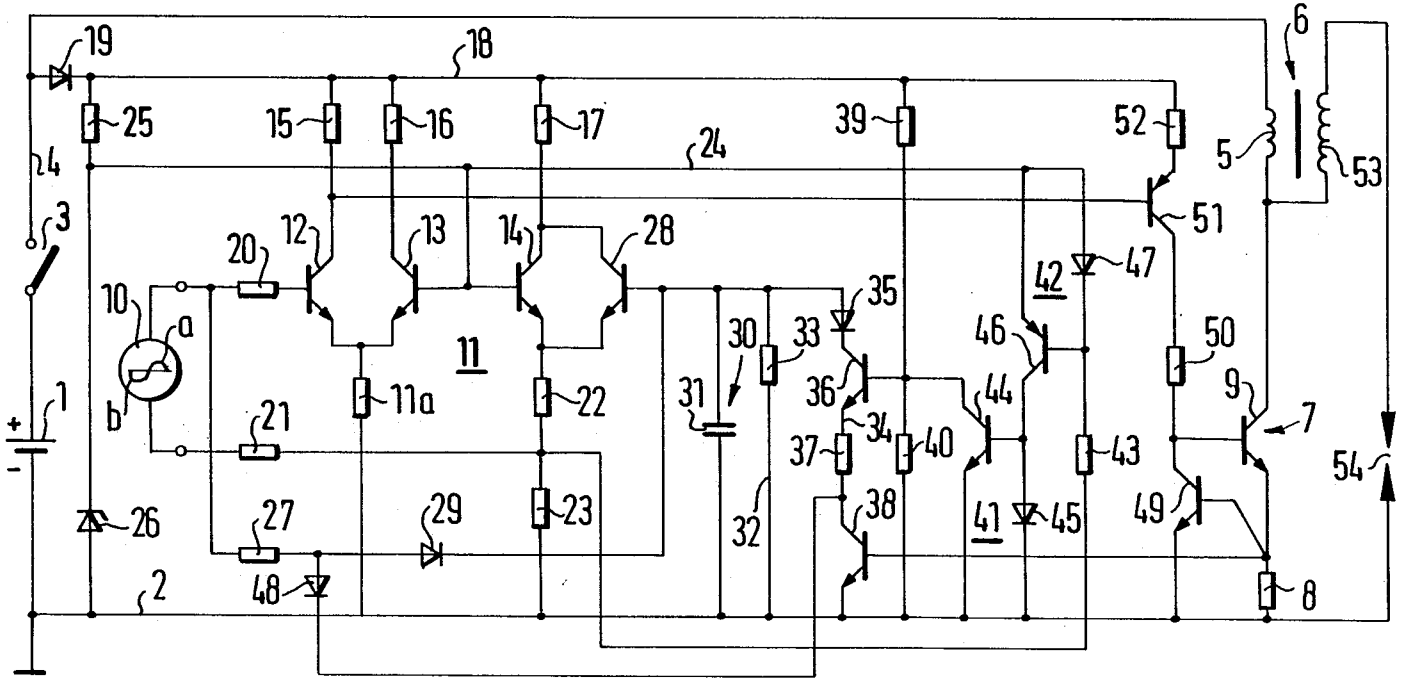

The ignition system shown should be associated with a combustion engine, not shown, of a motor vehicle, which likewise is not shown. This ignition system is supplied from a direct current source 1, which for example may be battery of the motor vehicle. A line 2 connected to ground extends from the negative terminal of the current source 1 and, from the positive terminal, a supply line 4 extends, which includes an operating switch (ignition switch) 3. The supply line 4 branches, through the primary winding 5 of an ignition coil 6 to a series circuit which consists of an electronic breaker 7 and a measuring resistor 8. The electronic breaker 7 is formed by (npn) power transistor 9 which is connected with its collector to the primary winding 5 and with its emitter to the measuring resistor 8.

The ignition events are triggered by a signal transducer 10 which is connected in advance of a trigger 11 with three transistors 12, 13, 14. The collectors of the transistors 12, 13, 14 are each connected, over a respective one of three resistors 15, 16, 17, with a line 18. The line 18 is connected over a reverse-polarity protective diode 19 to the supply line 4. The base of the transistor 12 is connected over a resistor 20 with one of the terminals of the signal transducer 10. The other terminal of the signal transducer 10 is connected through a resistor 21 to the common junction between two serially connected resistors 22, 23. The series circuit 22, 23 is connected between the emitter of the trigger transistor 14 and the ground line 2. The bases of the trigger transistors 13, 14 are connected to line 24 which starts from the connection between a resistor 25 and the cathode of a Zener diode 26. The resistor 25 and the Zener diode 26 form a series circuit between the line 18 and the ground line 2. The Zener diode 26 has its anode connected to the ground line 2. The emitters of the trigger transistors 12, 13 are connected together and in common over a resistor **11*a* with the ground line 2**.

The terminal of the signal transducer 10 which is connected through the resistor 20 to the trigger transistor 12 is connected through a charge resistor 27 with a base of a control transistor (npn) 28. The collector of the control transistor is connected to the collector of the trigger transistor 14, and the emitter of the control transistor is connected to the emitter of the trigger transistor 14. Between the base of the control transistor 28 and the charge resistor 27, a blocking diode 29 is included which has its anode facing the charge resistor 27. The base of the control transistor 28 is at the same time connected over an electrical storage device 30, preferable a capacitor 31, to the ground line 2. The storage device 30 has a shunt branch 32 of high resistance value. The shunt branch 32 preferably is formed by a resistor 33 connected in parallel to the storage device 30. Further, the storage device 30 has a shunt branch circuit 34 of low resistanc value. The shunt branch 34 extends, starting from the terminal of the storage device 30 remote from the ground line 2, first over a blocking diode 35, then over the emitter-collector path of a (npn) control transistor 36, then through an ohmic resistor 37 and finally, over the emitter-collector path 7 of a (npn) discharge transistor 38. The base of the control transistor 36 is connected to the common connection between two voltage divider resistors 39, 40 which are serially connected. This series circuit 39, 40 is connected between the line 18 and ground line 2. Further, the base of the control transistor 36 is connected, with the interposition of two current mirrors 41, 42 and then over a resistor 43, with a common connection of volatage divider resistors 22, 23 between the trigger transistor 14 and the ground line 2.

The current mirror 41 consists of one (npn) transistor 44 and a diode 45. The transistor 44 has its collector connected to the base of the control transistor 35, and its emitter to the ground line 2. On its base, it is connected with the anode of the diode 45, which has its cathode connected to the ground line 2.

The second current mirror 42 consists of a pnp transistor 46 and a diode 47. The transistor 46 is connected with its emitter to a line 24 having a stabilized voltage thereon and with its collector to the base of the transistor 44 associated with the first current mirror and with its base connected both to the resistor 43 as well as to the cathode of the diode 47, the anode of which is likewise connected to the line 24 carrying stabilized voltage. The discharge transistor 38 is connected with its collector on the connection between the charge resistor 28 and the blocking diode 29, with its emitter to the ground line 2 and with its base on the connection formed between the breaker 7 and the measuring resistor 8. Further, the connection provided between the breaker 7 and the measuring resistor 8 is connected to the base of an (npn) current limiting transistor 49, the emitter of which is connected to the ground line 2 and the collector to the base of the final transistor 9 forming the breaker 7. Further, the base of the final transistor 9 forming the breaker 7 is connected over a resistor 50 with a collector of a (pnp) driver transistor 51, the emitter of which is connected over a resistor 52 with the line 18 and the base of which with the collector of the trigger transistor 12.

The connection between the primary winding 5 and the breaker 7 is a starting point for the secondary circuit of the ignition coil 6 which first leads through the secondary winding 53 associated with the ignition coil 6 and thereafter through a spark plug 54 to the ground line 2.

OPERATION

The ignition arrangement just described operates as follows:

As soon as the operating switch 3 is closed, the ignition system becomes operative. Let it be assumed that the signal transducer, which operates similarly to a small alternating current generator, just provides the positive half wave a, so that, in dependence thereof, the emitter collector paths of the transistors 12, 51, 9 will be current conductive and current will flow over the primary winding 5 of the ignition coil 6, in order to store ignition energy for the coming ignition event. After the positive half wave a has exceeded the peak value, and has dropped again to a predetermined voltage value, transistors 12, 51, 9 will be controlled at their emitter-collector paths into blocking condition, whereby the current carried over the primary winding 5 is interrupted and the secondary winding 53 associated with the ignition coil will have a high voltage pulse induced which generates an ignition spark at the spark plug 54.

The trigger threshold of the trigger 11 defined initially by the resistors 22, 27 is shifted so that about the same energy supply is ready for ignition sparks up to high rotary speeds. That means that the switching threshold is then moved away from the peak value of the positive half wave a. This event can also be looked at in this manner that then the "dwell angle" that is, an angle of rotation relative to the crank shaft of the internal combustion engine, through which current flow in the primary winding 5 extends, is increased. To this end, a capacitor 31 forming an electrical storage device 30 is provided. This capacitor 31 is slowly discharged when the signal transducer 10 supplies it negative half wave b, by discharge via the resistor 33. When the control signal, upon rising of the positive half wave to the peak value has reached a predetermined level, capacitor 31 starts to charge over the charge resistor 27 and the blocking diode 29. At the same time, as already described, the current flow through the primary winding 5 and the breaker 7 is also connected. The current rise in the primary winding 5 and on the meansuring resistor 8 will cause a temporal increase in the voltage drop on the measuring resistor 8. When the primary winding 5 has reached a current value which insures that sufficient energy for an effective spark is provided, the limiting transistor 49 will branch from the base of the final transistor 9 so much current that the previously mentioned current value is maintained. Simultaneously, the discharge transistor 38 is controlled at its emitter-collector path into current-carrying state, whereby a fast discharge of the capacitor will result due to the shunt branch 34 with the low resistance value. So that this discharge can be unambiguously determined, charge flow from the signal transducer 10 to the capacitor 31 over the circuit elements 27, 29 is inhibited, by switching the resistor 27 over the blocking diode 48 through the emitter-collector path of the discharge transistor 38 on the ground line 2. So that the discharge of the capacitor 31 will remain undisturbed even upon voltage variations of the current source 1, the conductivity of the emitter-collector path of the control transistor is so changed due to the voltage divider 39, 40 connected to the supply voltage, that variations of the supply voltage are compensated by this change in conductivity.

The shift of the switching threshold of the trigger 11 occurs in the manner, that the capacitor 31 gradually controls the emitter collector path of the control transistor 28 into current conductive state. It has to be considered, that first the potential on the emitter of trigger transistor 14 must match the potential at the emitter of the trigger transistor 12 or at the emitter of the trigger transistor 13, respectively. The shift of the switching threshold associated with the trigger 11 then is obtained by change of the potential of the connection between the resistors 22, 23, and in a sense that with increasing speed, the switching threshold moves away from the peak value of the positive half wave.

Distortions upon shift of the switching threshold associated with the trigger 11 may result also in dependence on the speed of he combustion engine and also in dependence of dispersion of characteristics of the transducers which are being used. To compenstae such distortions, the conductivity of the emitter-collector path of the control transistor 36 is additionally influenced in dependence on the voltage at the connection between the resistor 22, 23, in such a manner that the voltage at this connection affects the base of the control transistor 36 through a network formed by the resistor 43 and the two interconnected current mirrors 41, 42.

We claim:

1. Ignition arrangement for combustion engines having a switching transistor (7) which is current-conductive when a trigger (11–14) is energized, an igntion coil (6), the primary winding (5) of which forms a series circuit with the switching transistor (7), and a signal transducer (10) connected in advance of the trigger (11–14), for supplying a control signal which reaches a peak value after expiration of a time interval, wherein the switching threshold of the trigger can be shifted, relative to the control signal, namely by use of an electrical storage device (31) which can be charged and discharged, and in which the discharge starts in dependence on a predetermined current value in the primary winding (5), the storage device (31) being chargeable by the control signal of the signal transducer (10) and being dischargeable, selectively, over a first, high-resistance discharge path (32–33) and over a second, switchable low-resistance discharge path (34–38) and being protected, during discharge, by a blocking element (29) from charging by said transducer control signal;

wherein, when current through said primary winding (5) reaches a predetermined value, charging of said storage device (31), including any charging originating at said transducer (10), ceases and said low-resistance discharge path from said storage device is switched (38) closed, thereby discharging said storgae device (31) rapidly and definitively while feedback of current to said storage device from said transducer (10) is blocked (29).

2. Ignition system according to claim 1 characterized in that the shunt circuit branch (34) with low resistance value can be connected by a discharge transistor (38) which has its base connected to a measuring resistor (8) and the current circuit of the primary winding (5) and is additionally used to disconnect charging of the store (30).

3. Ignition system according to claim 1 characterized in that the discharge path (32) with high resistance value is a resistor (33) continuously connected with, and parallel to, the storage device (30).

4. Ignition system in accordance with claim 1, characterized in that a control transistor (36) is connected in the discharge path (34) of low resistance value, the conductivity of which is dependent on battery voltage.

5. Ignition system in accordance with claim 4, characterized in that the conductivity of the control transistor (36) is additionally dependent on the speed of the combustion engine and the peak value of the control signal (a, b) in that the control electrode of the control transistor (36) has a voltage, dependent on the charge of the storage device, applied thereto, preferably over two current mirrors (41, 42).

6. Ignition system according to claim 1, characterized in that the storage device (30) is a capacitor.

7. Ignition system according to claim 2 characterized in that the discharge path (32) with high resistance value is a resistor (33) continuously connected with, and parallel to, the storage device (30).

8. Ignition system in accordance with claim 2, characterized in that a control transistor (36) is connected in the discharge path (34) of low resistance value, the conductivity of which is dependent on battery voltage.

9. Ignition system in accordance with claim 3, characterized in that a control transistor (36) is connected in the shunt circuit branch (34) of low resistance value, the conductivity of which is dependent on battery voltage.

10. Ignition system in accordance with claim 8, characterized in that the conductivity of the control transistor (36) is additionally dependent on the speed of the combustion engine and the peak value of the control signal (a, b) in that the control electrode of the control transistor (36) has a voltage, dependent on the charge of the store, applied thereto, preferably over two current mirrors (41, 42).

11. Ignition system in accordance with claim 9, characterized in that the conductivity of the control transistor (36) is additionally dependent on the speed of the combustion engine and the peak value of the control signal (a, b) in that the control electrode of the control transistor (36) has a voltage, dependent on the charge of the store, applied thereto, preferably over two current mirrors (41, 42).

12. Ignition system according to claim 2, characterized in that the store (30) is a capacitor.

13. Ignition system according to claim 3, characterized in that the store (30) is a capacitor.

14. Ignition system according to claim 4, characterized in that the store (30) is a capacitor.

15. Ignition system according to claim 5, characterized in that the store (30) is a capacitor.

16. Ignition system according to claim 6, charaterized in that the store (30) is a capacitor.

17. Ignition system according to claim 7, characterized in that store (30) is a capacitor.

18. Ignition system according to claim 8, characterized in that the store (30) is a capacitor.

19. Ignition system according to claim 9, characterized in that the store (30) is a capacitor.

20. Ignition system according to claim 10, characterized in that the store (30) is a capacitor.

* * * * *